US008136898B2

(12) United States Patent
Rüter

(10) Patent No.: US 8,136,898 B2
(45) Date of Patent: Mar. 20, 2012

(54) CLOSING AND RETAINING DEVICE FOR AN EXTENSION GUIDE

(75) Inventor: Stefan Rüter, Bad Oeynhausen (DE)

(73) Assignee: Paul Hettich GmbH & Co., Kirchlengern (DE)

( * ) Notice: Subject to any disclaimer, the term of this patent is extended or adjusted under 35 U.S.C. 154(b) by 379 days.

(21) Appl. No.: 12/300,303

(22) PCT Filed: Apr. 24, 2007

(86) PCT No.: PCT/EP2007/053985

§ 371 (c)(1),
(2), (4) Date: May 15, 2009

(87) PCT Pub. No.: WO2007/134932

PCT Pub. Date: Nov. 29, 2007

(65) Prior Publication Data

US 2009/0309470 A1 Dec. 17, 2009

(30) Foreign Application Priority Data

May 24, 2006 (DE) ..... 20 2006 008 436 U
Feb. 9, 2007 (DE) ..... 20 2007 001 897 U

(51) Int. Cl.
*A47B 95/00* (2006.01)

(52) U.S. Cl. ..... 312/333

(58) Field of Classification Search ..... 312/330.1, 312/333, 319.1, 334.1, 334.6, 334.7, 334.14, 312/334.27, 334.32, 334.44
See application file for complete search history.

(56) References Cited

U.S. PATENT DOCUMENTS 5,306,081 A * 4/1994 Fukumoto ..... 312/334.44
5,364,179 A * 11/1994 Brustle et al. ..... 312/333
5,393,137 A * 2/1995 Bivens et al. ..... 312/332
6,629,738 B2 * 10/2003 Salice ..... 312/333
6,736,471 B2 * 5/2004 Lin ..... 312/333
6,953,233 B2 * 10/2005 Lam et al. ..... 312/333
6,979,065 B2 * 12/2005 Egger ..... 312/333
7,108,339 B2 * 9/2006 Berger ..... 312/333
7,374,260 B2 * 5/2008 Lu ..... 312/333
7,384,108 B2 * 6/2008 Lam et al. ..... 312/334.44
(Continued)

FOREIGN PATENT DOCUMENTS

AT 7 234 U1 12/2004
(Continued)

OTHER PUBLICATIONS

Specification translation of DE20318929, ALFIT AG, Nov. 15, 2005.*

*Primary Examiner* — Darnell M. Jayne
*Assistant Examiner* — Hiwot Tefera
(74) *Attorney, Agent, or Firm* — Barnes & Thornburg LLP

(57) ABSTRACT

A closing and retaining device for an extension guide includes a rail of an extension guide, a housing slidably disposed on the rail, and a driver disposed on the housing. The closing and retaining device also includes a damper housing retained in the housing, a displaceable piston coupled between the damper housing and the driver, wherein the damper housing is displaceable in a direction of movement of the piston, and a latch disposed on the driver to connect the piston to the driver. After the piston is connected to the driver, the damper housing is pushed into position by the driver.

9 Claims, 6 Drawing Sheets

U.S. PATENT DOCUMENTS

| | | | | |
|---|---|---|---|---|
| 7,472,973 | B2 * | 1/2009 | Huang | 312/333 |
| 7,481,505 | B2 * | 1/2009 | Orita | 312/333 |
| 7,731,311 | B2 * | 6/2010 | Lam et al. | 312/333 |
| 7,845,744 | B2 * | 12/2010 | Chen et al. | 312/334.6 |
| 7,874,597 | B2 * | 1/2011 | Tomita et al. | 292/137 |
| 7,905,561 | B2 * | 3/2011 | Ritter | 312/333 |
| 2003/0141638 | A1 * | 7/2003 | Salice | 267/34 |
| 2004/0000850 | A1 * | 1/2004 | Lam Harn et al. | 312/333 |
| 2004/0104650 | A1 * | 6/2004 | Egger | 312/333 |
| 2004/0107536 | A1 * | 6/2004 | Hollenstein | 16/94 R |
| 2004/0174101 | A1 * | 9/2004 | Lin | 312/333 |
| 2005/0098394 | A1 * | 5/2005 | Baldreich | 188/67 |
| 2005/0116593 | A1 * | 6/2005 | Berger | 312/333 |
| 2006/0186772 | A1 * | 8/2006 | Lam et al. | 312/333 |
| 2007/0046159 | A1 * | 3/2007 | Hoffman | 312/333 |
| 2007/0188060 | A1 * | 8/2007 | Nussbaumer et al. | 312/333 |
| 2009/0189499 | A1 * | 7/2009 | Yang | 312/334.44 |
| 2009/0273263 | A1 * | 11/2009 | Berger | 312/334.1 |

FOREIGN PATENT DOCUMENTS

| | | | |
|---|---|---|---|
| AT | 7 909 | U1 | 11/2005 |
| DE | 20 2004 018189 | U1 | 3/2005 |

* cited by examiner

CLOSING AND RETAINING DEVICE FOR AN EXTENSION GUIDE

CROSS-REFERENCE TO RELATED APPLICATION(S)

This is a National Phase Patent Application that relies for priority on International Patent Application No. PCT/EP2007/053985, filed on Apr. 24, 2007, on German Patent Application No. DE 20 2006 008 436.3, filed on May 24, 2006, and on German Patent Application No. DE 20 2007 001 897.5, filed on Feb. 9, 2007, the contents of each of which are incorporated herein by reference.

FIELD OF THE INVENTION

The present invention relates to a closing and retaining device for an extension guide. More specifically, the present invention relates to a closing and retaining extension guide with a housing on which a driver, which can be coupled to a rail of a the extension guide, is retained in a displaceable manner. Even more specifically, the present invention relates to a closing and retaining device for an extension guide having a damper housing is fixed on the housing, a driver, and a displaceable piston, which can be coupled to the driver via a latching connection arranged on the damper housing.

DESCRIPTION OF THE RELATED ART

AT 007 909 U1 discloses an automatic retraction mechanism for drawer extension guides, in which a damper is provided.

With respect to the mechanism described in AT 007 909 U1, the damper is secured in a housing in a positionally fixed manner such that a front end of the piston rod is arranged in a predetermined position. If the piston rod is to be connected to the driver of the automatic retraction mechanism via latching means, tolerances may make it possible that a latching connection does not come about or is damaged. In addition, retrospective installation of the damper is made more difficult, since exact installation is required. Also, it is difficult to produce a latching connection between the piston rod and the driver without removing the automatic retraction mechanism housing from the rail.

SUMMARY OF THE INVENTION

It is therefore an aspect of the present invention to provide a closing and retaining device which is easily installed and in which the damper can also be fitted retrospectively in a simple manner.

This object is achieved, among others, by a closing and retaining device of the present invention.

According to the invention, the damper housing can be displaced in the direction of movement of the piston. After the latching connection is coupled in order to fix the piston to the driver, it is possible for the damper housing to be pushed back into an operating position by the driver. As a result, the damper can also be fitted retrospectively in a simple manner, since the displaceability means that a certain compensation of tolerances takes. The compensation of the tolerances takes place, in particular, if the damper together with the piston is located closer to the driver in its latching position than in its subsequent operating position. This ensures that the latching connection is securely coupled in order to activate the damper. Furthermore, an automatic adjustment takes place during assembly, since, after the coupling, the damper housing can also be displaced into the desired operating position. This facilitates the maneuverability, since, during the assembly, no special knowledge about the correct position is required, but rather assembly can take place in a simple manner.

The force for displacing the damper housing relative to the housing of the closing and retaining device is preferably greater than the force for coupling the latching connection in order to fix the piston rod on the driver. As a result, assembly can take place, even with the rail extended, by the damper being completely pushed onto the closing and retaining device. The damper is only pushed back when the latching connection is coupled.

However, it is also possible to configure the force for displacing the damper housing relative to the housing to be smaller than the force for coupling the latching connection. In this embodiment, assembly takes place with the rail pushed in and secured, with the damper being pushed until the latching connection has come about.

According to one contemplated configuration of the invention, the damper housing is secured on the housing of the automatic retraction mechanism by clamping. This ensures, among other things, that the force for displacing the damper housing is greater than the force for coupling the latching connections. However, the clamping force is smaller than the forces which occur when the damper is brought back in order to close the furniture part, and therefore the damper housing is automatically aligned. Instead of a clamping securing of the damper housing, corresponding latching means, ensuring fixing of the damper housing, can also be provided. In such a case, the damper housing may be retained in a movable manner with a certain amount of play between two stops.

For coordinated movement of the damper housing, means for guiding the movement of the damper housing may be provided. If so, the means for guiding the movement of the damper housing may avoid transverse forces. In such a case, even when the piston is extended out of the damper housing by means of the driver, the damper housing remains in its operating position, i.e. the retaining forces between the housing and the damper housing are greater than the forces for the extension of the piston by means of the driver. If latching means are provided, the retaining forces by means of the latching means can also be greater than the forces for extending the piston.

For a simple mechanical configuration of the latching connection, two elastic latching webs can be integrally formed on the housing, said latching webs engaging by means of a projection in a respective cutout on the damper housing. However, other latching mechanisms can also be used.

According to a further configuration of the invention, the damper housing is of cylindrical design and has at least one web which is guided into a slot on the housing of the automatic retraction mechanism. As a result, only a linear movement of the damper housing relative to the housing of the automatic retraction mechanism is permitted. Moreover, with this construction, positionally correct assembly is ensured.

For a simple mechanical coupling, a spherical section, which can be latched into place in a receptacle on the driver, is provided at the end of the piston rod. As a result, the driver can also be pivoted relative to the piston rod, which is precisely what is needed when a prestressed parking (or stopping) position of the driver is reached.

For a compact construction, the damper housing can be fixed in a receptacle of the housing of the automatic retraction mechanism.

Other aspects of the invention also should be gleaned by those skilled in the art from the description that follows and the drawings appended hereto.

BRIEF DESCRIPTION OF THE DRAWINGS

The invention is explained in more detail below using one or more embodiments, and with reference to the attached drawings, in which.

DETAILED DESCRIPTION OF EMBODIMENT(S) OF THE INVENTION

The invention will now be described in connection with one or more embodiments. As should be appreciated by those skilled in the art, the embodiment(s) discussed herein are intended to be exemplary of the broad scope of the invention. The embodiment(s) is(are) not intended to be limiting of the invention. As should be appreciated by those skilled in the art, there are numerous variations and equivalents that are also intended to fall within the scope of this invention.

Figure 1:
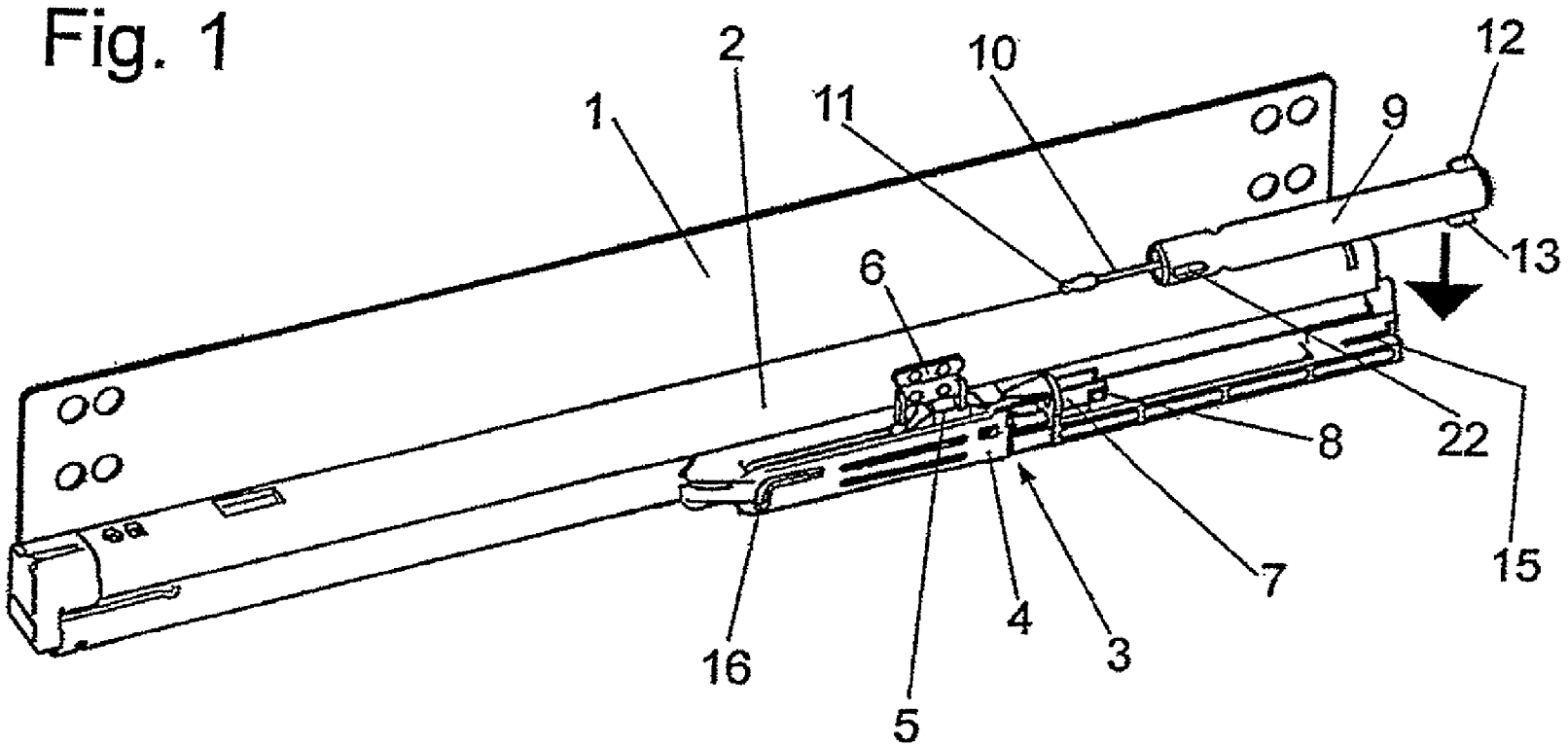
FIG. 1 shows a perspective view of an automatic retraction mechanism for an extension guide during the assembly of the damper.

With reference to FIG. 1, an automatic retraction mechanism for an extension guide is fitted on a furniture body, with, for example, a rail 1 of the extension guide being secured on a side wall of the furniture body for the mounting of a drawer. The rail 1 is coupled to one or more displaceable rails 2 via rolling bodies.

An automatic retraction mechanism 3 is provided between the stationary rail 1 and the movable rail 2. The automatic retraction mechanism assists with a closing movement and ensures that the movable furniture part is retained in a closed position. The automatic retraction mechanism 3 comprises an elongate housing 4 on which a driver 5, which is prestressed via a spring, is guided in a movable manner. The driver 5 is coupled to the rail 2 via a connecting element 6. In the illustrated embodiment, the driver 5 can be moved along a curved guide 16. The curved guide 16, which is angled at one end, permits pivoting of the driver 5 such that the connecting element 6 can be detached from the driver 5 when the furniture part is opened to a predetermined extent.

For the retraction movement of the driver 5, it is frequently desirable to provide damping in order to prevent the movable furniture parts from colliding. In the case of the automatic retraction mechanism 3 according to the invention, such a damper can be retrofitted in a simple manner.

A damper comprises a cylindrical damper housing 9 in which a displaceable piston is mounted with a piston rod 10. The piston rod 10 is movable in a smooth-running manner out of the damper housing 9 in the extension direction and is movable stiffly in a suitable manner in the opposite retraction direction in order to damp the closing movement. At one end, the piston rod 10 has a spherical section 11 which can be latched into a receptacle on the driver 5 in order to couple the movement of the piston and the piston rod 10 to the driver 5.

Figure 2A:
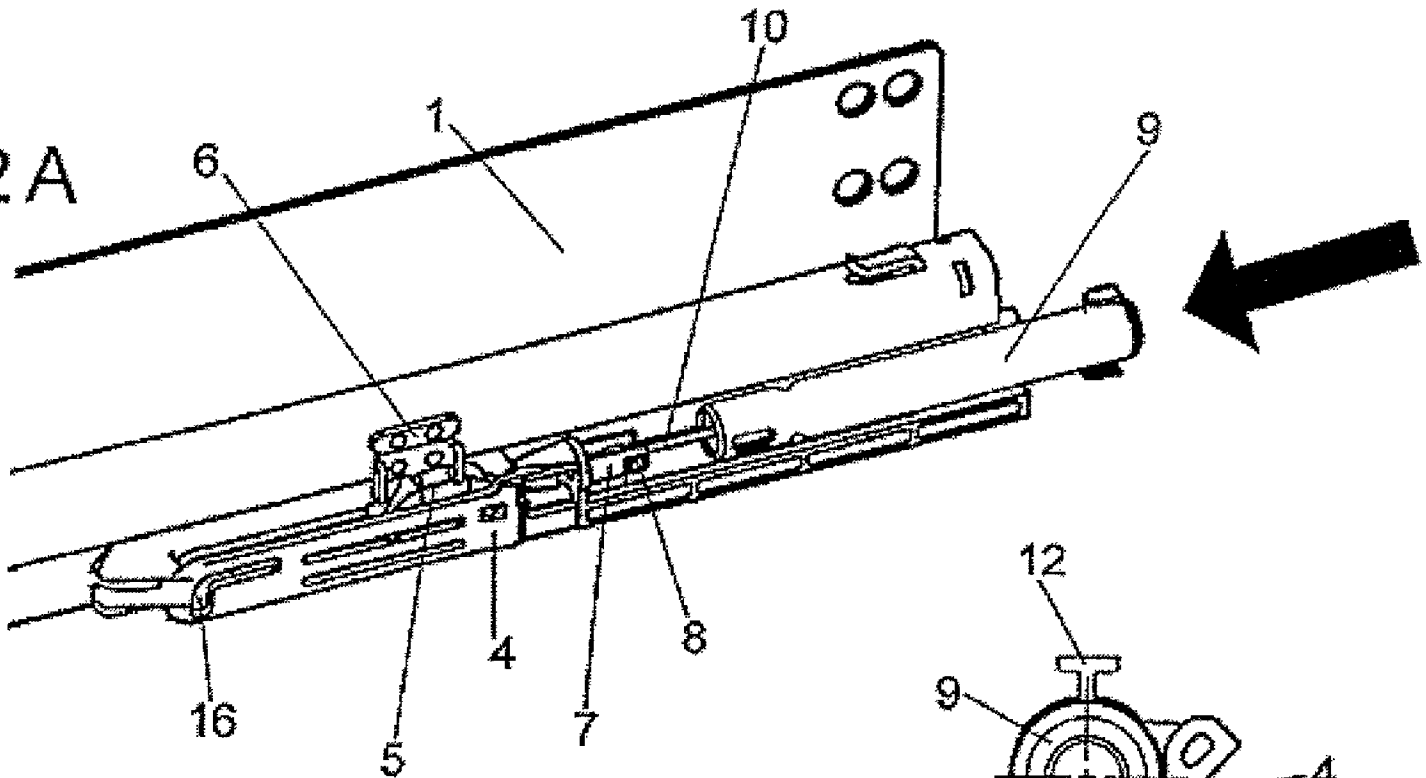
FIG. 2A shows a perspective view of the automatic retraction mechanism with the damper nearly completely fitted.
Figure 2B:
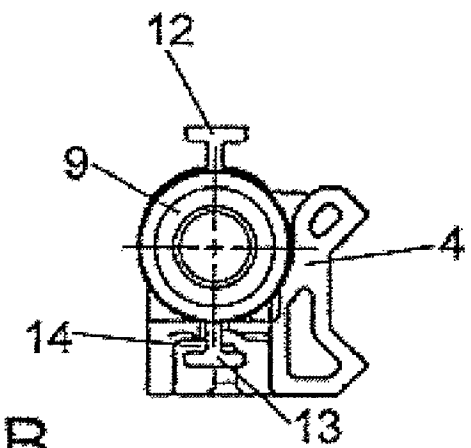
FIG. 2B shows a view of the damper housing and of the housing of the automatic retraction mechanism.

Webs 12, and 13 which ensure correct alignment of the damper housing 9 during assembly, are provided on opposite sides of the damper housing 9. A receptacle for the damper housing 9 is formed on the housing 4 of the automatic retraction mechanism, with a slot 15 being formed between plates 14 (see FIG. 2B) at one end of the housing 4 such that a web 12 or 13 can be fitted into the slot. The damper housing 9 can also be fitted in a manner rotated through 180° by the formation of two webs 12 and 13.

Furthermore, an elongate cutout 22 is formed on opposite sides of the damper housing 9. One of the elongate cutouts 22 is visible in FIG. 1, for example. The elongate cutout 22 on the side facing the driver 5 serves to latch the damper housing 9 to the housing 4, as does the elongate cutout 22 that is not visible in FIG. 1. Latching webs 7, on which outwardly directed projections 8 are integrally formed, are formed on the housing 4, such that, when the damper housing 9 is fitted onto the latching webs 7, the projections 8 engage in the cutouts 22. The damper housing 9 is secured on the housing 4 by clamping via the latching webs 7 and the projections 8 or via other means for generating frictional force.

For the assembly, it is necessary for the piston with the piston rod 10 to be coupled to the driver 5. For this purpose, the damper is first of all brought into the position illustrated in FIG. 2A. The movable rail 2 is then secured by hand in the closed position and the damper housing is displaced forward. The webs 12 and 13 on the damper housing and the slot 15 on the housing 4 ensure the correct position for latching the projections 8 to the latching webs 7 and to the cutouts 22 on the damper housing 9, with the latching into place being acoustically perceptible. The damper housing 9 is then moved further forward beyond its operating position in the direction of the driver 5 with the movable rail 2 being supported, and, as a result, the spherical section 11 can latch in the corresponding receptacle on the driver 5 or on a component connected thereto, which can likewise be acoustically perceptible.

Figure 3:
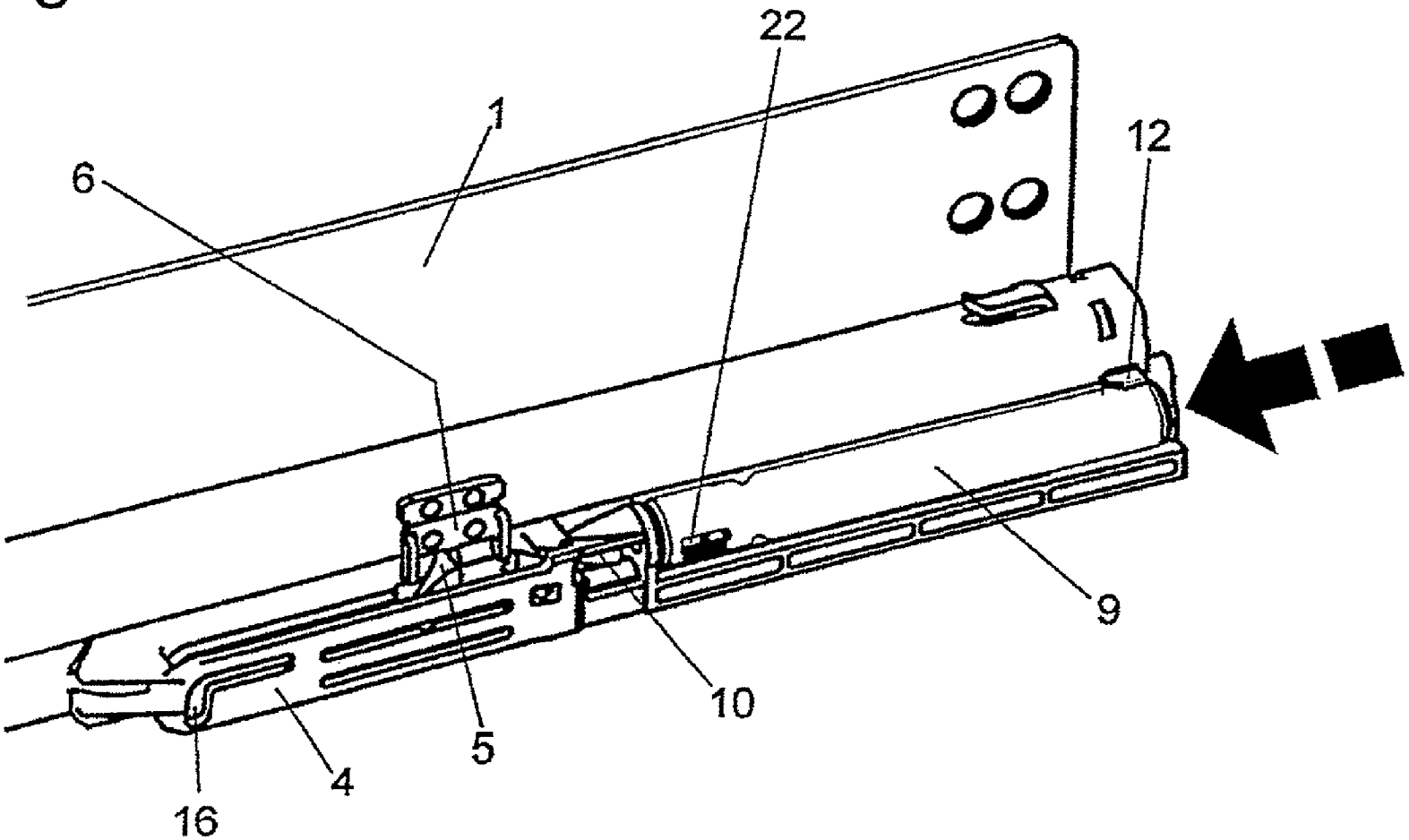
FIG. 3 shows a perspective view of the automatic retraction mechanism after assembly of the damper.

As an alternative, it is also possible for the driver 5 to be retained in an extended position on the curved guide 16 such that, when the damper housing 9 is pushed in, a connection between the spherical section 11 and the corresponding receptacle on the driver 5 still cannot be produced. (See, e.g., FIG. 3.) However, this is not a problem, since, when the driver 5 is moved back, the receptacle is pressed against the spherical section 11. In this embodiment, the damper housing 9 is secured on the housing 4 by clamping until the piston rod 10 latches to the driver 5. After the piston rod 10 is latched, upon further movement of the driver 5, the damper housing 9 is displaced. The force for displacing the damper housing 9 is greater than the force for extending the damper with the piston. Therefore, after the latching operation, the damper housing 9 remains for all further rail movements in an operating position which is predetermined by the installation and tolerance position. If the damper housing 9 is inadvertently pushed forward again, for example during cleaning work or when moving house (e.g., moving the furniture to a new location), etc., then the next normal closing operation of the guide automatically reproduces the operating position.

Figure 4:
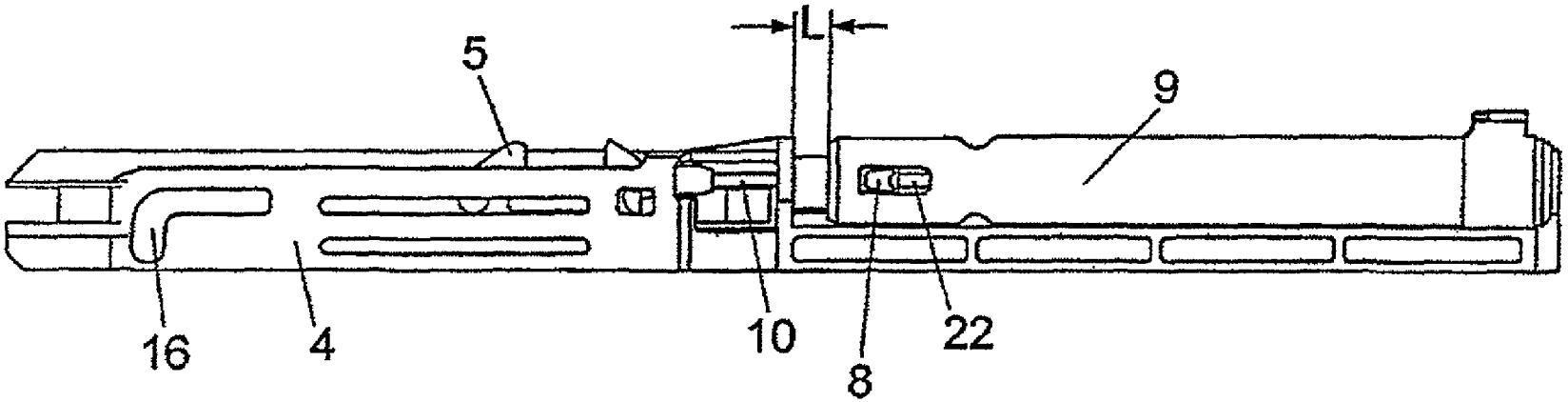
FIG. 4 shows a side view of the automatic retraction mechanism with the damper.
Figure 5:
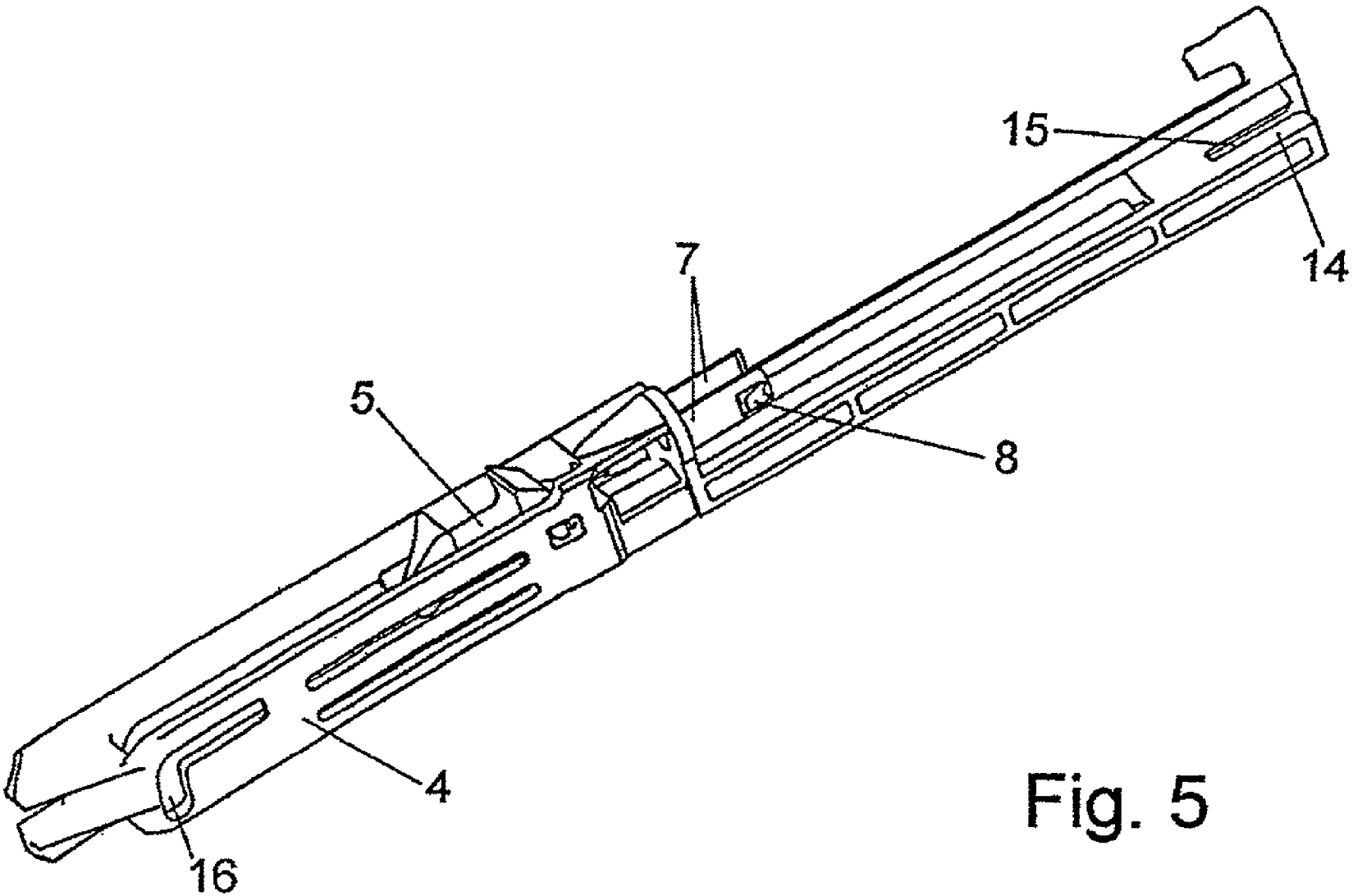
FIG. 5 shows a perspective view of the automatic retraction mechanism without the damper.
Figure 6:
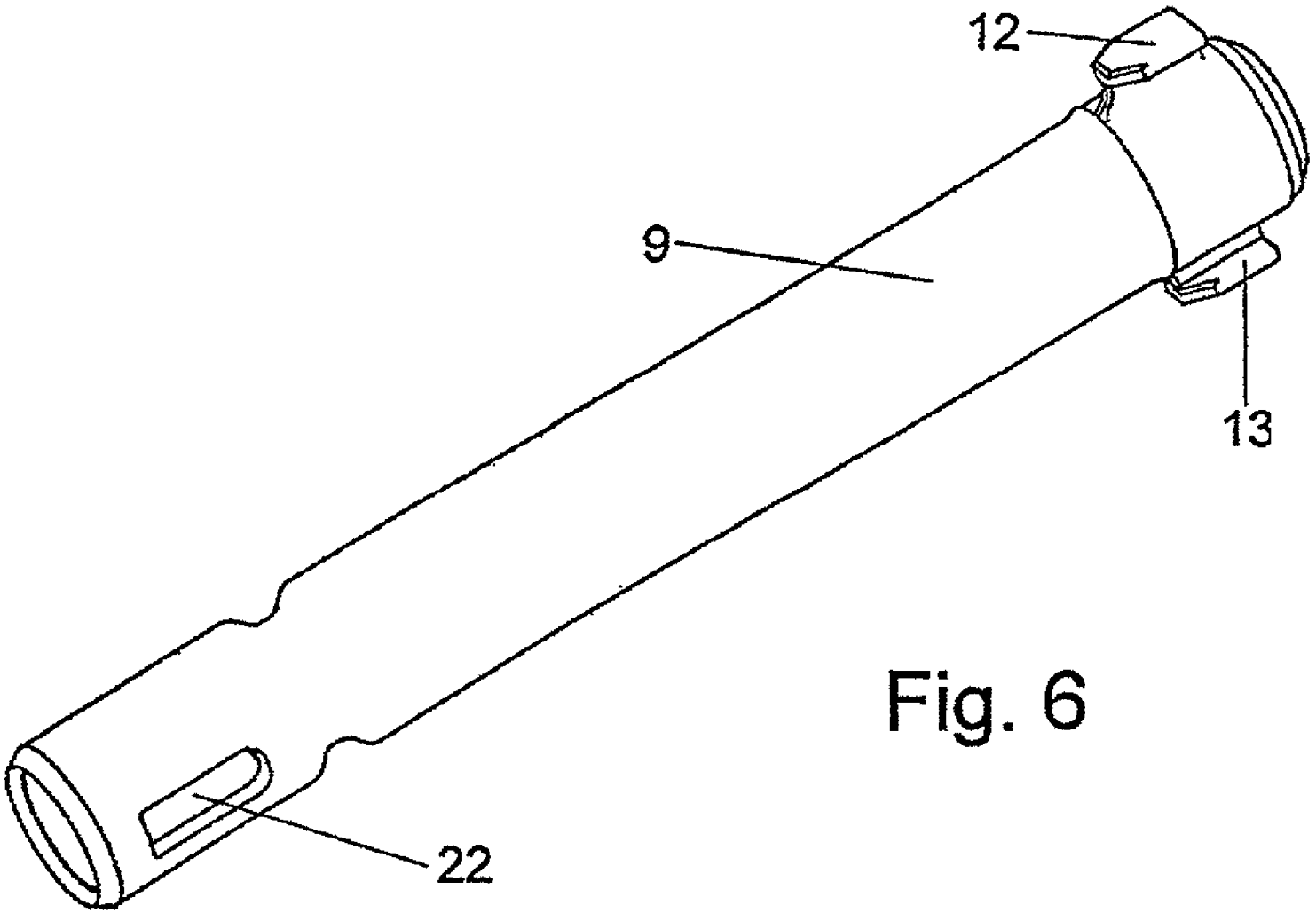
FIG. 6 shows a perspective view of the damper housing.

In order to adjust the operating position, the latching projections 8 can be moved in the cutout 22, which is designed as an elongated hole. As a result, it is ensured in each case that, after the damper housing 9 is pushed into the housing 4 of the automatic retraction mechanism, the driver 5 and piston rod 10 are coupled in order to activate the damper. In addition, tolerances can be compensated for by the displaceable mounting of the damper housing 9 between two stops. A possible displacement distance L (see FIG. 4) of the damper housing 9, relative to the housing 4 of the automatic retraction mechanism, can lie in the range of, for example, up to 5 mm.

The automatic retraction mechanism 3 according to the invention can therefore be retrofitted in a simple manner with a damper, with erroneous assembly being reliably avoided. In order to couple the damper housing 9 to the housing 4 of the automatic retraction mechanism, other latching means instead of the latching webs 7 and the cutouts 22 can also be provided. The means for guiding the T-shaped webs 12 and 13 can also differ in configuration.

In the exemplary embodiment illustrated, the closing and retaining device is designed as an automatic retraction mechanism for furniture. Of course, it is also possible to use the closing and retaining device in horizontal or vertical sliding doors, high-level extensions and other movable components in which a linear movement is firstly to be assisted and secondly damped.

The invention claimed is:

1. A closing and retaining device for an extension guide, comprising:

a rail of an extension guide;

a housing slidably disposed on the rail;

a driver disposed on the housing;

a damper housing retained in the housing;

a displaceable piston coupled between the damper housing and the driver, wherein the damper housing is displaceable in a direction of movement of the piston;

a latch disposed on the driver to connect the piston to the driver, wherein, after the piston is connected to the driver, the damper housing is pushed into position by the driver;

wherein the damper housing is retained by being latched onto the housing via two elastic latching webs integrally formed in the housing, the latching webs including projections which engage respective cutouts in the damper housing, and the cutouts provide a displacement distance to adjust the operating position of the damper housing.

2. The closing and retaining device of claim 1, wherein a first force for displacing the damper housing relative to the housing is less than or equal to a second force for connecting the piston to the driver.

3. The closing and retaining device of claim 1, wherein the damper housing is clamped onto the housing.

4. The closing and retaining device of claim 1, wherein the damper housing is retained in the housing and is moveable between two stops.

5. The closing and retaining device of claim 4, further comprising:

at least two guides disposed on the damper housing to guide movement of the damper housing with respect to the housing.

6. The closing and retaining device of claim 1, wherein, when the piston rod is extended out of the damper housing by the driver, the damper housing remains in an operating position.

7. The closing and retaining device of claim 1, wherein the damper housing comprises at least one guide that engages a slot in the housing.

8. The closing and retaining device of claim 1, wherein the piston comprises a spherical section at one end that latches into a receptacle on the driver.

9. The closing and retaining device of claim 1, wherein the damper housing is fixed in a receptacle of the housing.

* * * * *